US007637011B2

(12) United States Patent
Brück et al.

(10) Patent No.: US 7,637,011 B2
(45) Date of Patent: Dec. 29, 2009

(54) METHOD FOR PRODUCING A STRUCTURED METAL SHEET FOR EXHAUST-GAS TREATMENT DEVICES AND APPARATUS FOR PRODUCING THE STRUCTURED METAL SHEET

(75) Inventors: Rolf Brück, Bergisch-Gladbach (DE); Ludwig Wieres, Overath (DE); Jan Hodgson, Troisdorf (DE); Gottfried-Wilhelm Haesselmann, Kürten (DE)

(73) Assignee: EMITEC Gesellschaft fuer Emissionstechnologie mbH, Lohmar (DE)

( * ) Notice: Subject to any disclaimer, the term of this patent is extended or adjusted under 35 U.S.C. 154(b) by 630 days.

(21) Appl. No.: 11/291,003

(22) Filed: Nov. 30, 2005

(65) Prior Publication Data

US 2006/0143919 A1 Jul. 6, 2006

Related U.S. Application Data

(63) Continuation of application No. PCT/EP2004/005765, filed on May 28, 2004.

(30) Foreign Application Priority Data

May 30, 2003 (DE) ..... 103 24 889
Jun. 18, 2003 (DE) ..... 103 27 455
Jan. 9, 2004 (DE) ..... 10 2004 001 419

(51) Int. Cl.

| | |
|---|---|
| ***B21B 1/00*** | (2006.01) |
| ***B21B 13/02*** | (2006.01) |
| ***B21B 23/00*** | (2006.01) |
| ***B21B 38/00*** | (2006.01) |
| ***B21D 51/16*** | (2006.01) |
| ***B23P 11/00*** | (2006.01) |
| ***B23P 15/16*** | (2006.01) |

(52) U.S. Cl. ..... 29/890; 29/430; 29/432; 29/896.6; 72/31.07; 72/203; 72/366.2; 72/385

(58) Field of Classification Search ..... 29/430, 29/432, 458, 890, 896.6; 72/11.1, 31.07, 72/203, 366, 366.2, 379.6, 385; 428/98, 428/116

See application file for complete search history.

(56) References Cited

U.S. PATENT DOCUMENTS 1,298,172 A 3/1919 Bush (Continued)

FOREIGN PATENT DOCUMENTS

DE 1 008 692 5/1957

(Continued)

*Primary Examiner*—David P Bryant
*Assistant Examiner*—Alexander P Taousakis
(74) *Attorney, Agent, or Firm*—Laurence A. Greenberg; Werner H. Stemer; Ralph E. Locher

(57) ABSTRACT

A process for producing a structure in a smooth sheet-metal strip includes multiple process steps. In a first step, a first section of a smooth sheet-metal strip is fed to a first tool and a second section of the sheet-metal strip is fed to a second tool in a direction of advance. Then the sheet-metal strip is stopped. A sheet-metal machining of the first section of the sheet-metal strip is carried out using the first tool. A sheet-metal machining of the second section of the sheet-metal strip is carried out using the second tool, with the first feeding step being carried out simultaneously. An apparatus is provided for producing a sheet-metal strip of such a complex structure, which produces the structure with a very high degree of accuracy even when the materials properties differ.

7 Claims, 3 Drawing Sheets

U.S. PATENT DOCUMENTS

| | | | | |
|---|---|---|---|---|
| 1,495,637 | A * | 5/1924 | Fedders | 72/185 |
| 3,298,081 | A | 1/1967 | Terrell et al. | |
| 3,736,787 | A | 6/1973 | Fencl et al. | |
| 4,502,315 | A * | 3/1985 | Dubrovsky et al. | 72/385 |
| 4,567,630 | A * | 2/1986 | Ishida et al. | 29/6.2 |
| 4,711,009 | A * | 12/1987 | Cornelison et al. | 29/890 |
| 4,958,428 | A * | 9/1990 | Humpolik | 29/890 |
| 5,599,509 | A | 2/1997 | Toyao et al. | |
| 5,819,575 | A * | 10/1998 | Kobayashi et al. | 72/187 |
| 6,591,647 | B2 * | 7/2003 | Gerard | 72/17.3 |
| 2001/0033812 | A1 | 10/2001 | Nagura et al. | |
| 2008/0131654 | A1 * | 6/2008 | Bradford et al. | 428/118 |

FOREIGN PATENT DOCUMENTS

| | | | |
|---|---|---|---|
| DE | 41 30 673 | A1 | 3/1993 |
| DE | 197 24 289 | A1 | 12/1998 |
| DE | 102 08 871 | | 9/2003 |
| EP | 0776 711 | | 11/1996 |
| JP | 08261678 | | 3/1995 |
| JP | 200 222 4752 | | 8/2002 |
| SU | 508302 | | 5/1976 |
| WO | WO 01/80978 | | 1/2001 |
| WO | WO 03/097271 | | 11/2003 |

* cited by examiner

Fig. 3
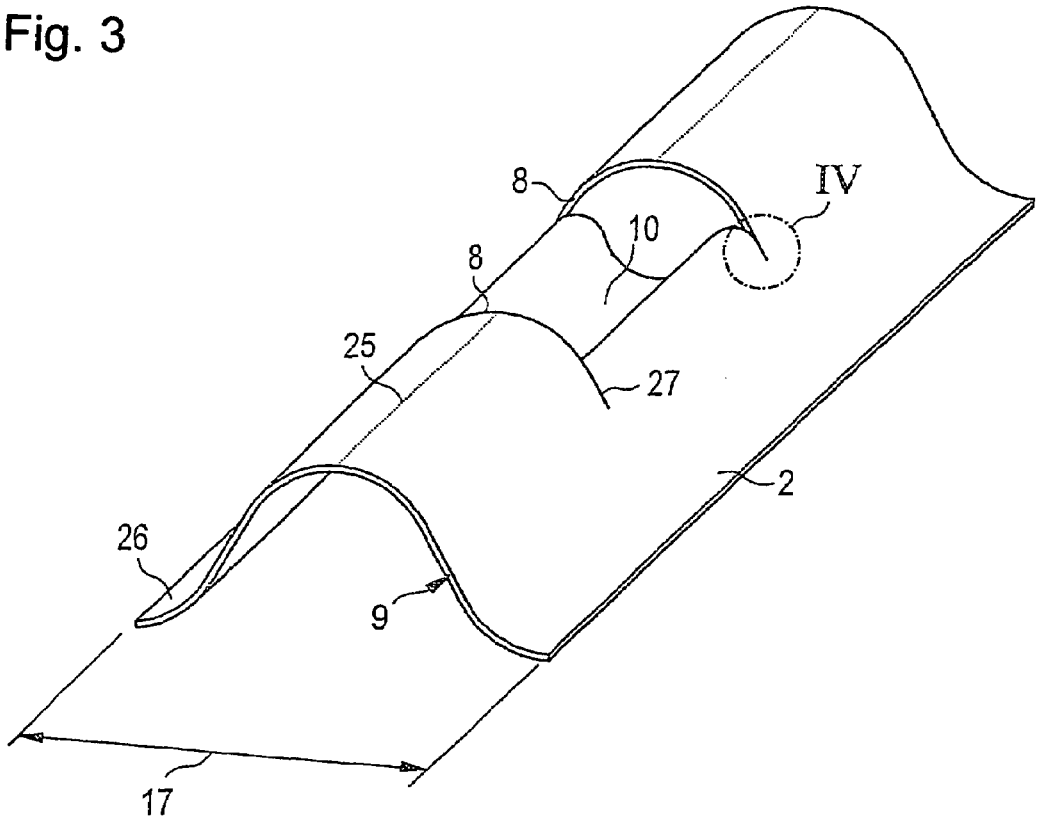
Fig. 4.1
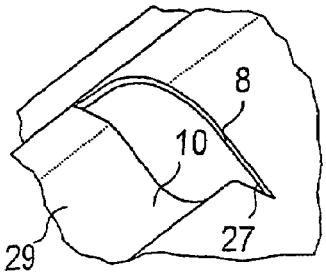
Fig. 4.2
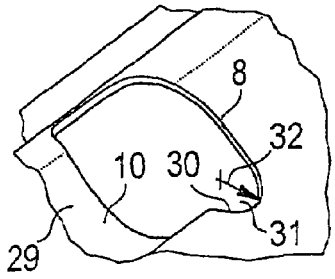
Fig. 4.3
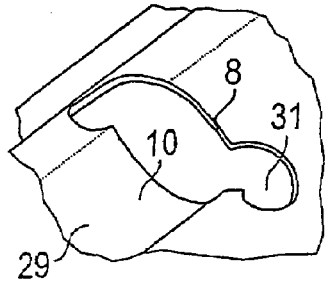

METHOD FOR PRODUCING A STRUCTURED METAL SHEET FOR EXHAUST-GAS TREATMENT DEVICES AND APPARATUS FOR PRODUCING THE STRUCTURED METAL SHEET

CROSS-REFERENCE TO THE RELATED APPLICATIONS

This is a continuation, under 35 U.S.C. §120, of copending international application No. PCT/EP 2004/005765, filed May 28, 2004, which designated the United States; this application also claims the priority, under 35 U.S.C. §119, of German patent application Nos. DE 103 24 889.7, filed May 30, 2003; DE 103 27 455.3, filed Jun. 18, 2003; and DE 10 2004 001 419.1 filed Jan. 9, 2004; the prior applications are herewith incorporated by reference in their entirety.

BACKGROUND OF THE INVENTION

Field of the Invention

The present invention relates to a process and an apparatus for producing a structure in a smooth sheet-metal strip, which is used in particular to produce exhaust-gas treatment devices for mobile internal combustion engines.

To treat the exhaust gas from mobile internal combustion engines, such as for example spark-ignition and diesel engines, it is known to dispose components or structures which provide a relatively large surface area in the exhaust pipe. These components are usually provided with an adsorbing, catalytically active or other coating, with intimate contact with the exhaust gas flowing past being realized on account of the large surface area of the components. Components of this type are, for example, filter elements for filtering out particulates contained in the exhaust gas, adsorbers for storing pollutants contained in the exhaust gas (e.g. $NO_x$) at least for a limited time, catalytic converters (e.g. three-way catalytic converters, oxidation catalytic converters, reduction catalytic converters, etc.), diffusers for influencing the flow of and/or swirling up of the exhaust gas flowing through, or heating elements, which heat the exhaust gas to a desired temperature straight after a cold start by the internal combustion engine. In view of the conditions of use in the exhaust system of an automobile, the following support substrates have fundamentally proven suitable: ceramic honeycomb bodies, extruded honeycomb bodies and honeycomb bodies made from metal foils. Thermally stable and corrosion-resistant metal sheets are particularly suitable production starting materials, on account of the fact that these support substrates always have to be adapted to their functions.

It is known to produce honeycomb bodies with a plurality of at least partially structured metal sheets, which are then introduced into a housing so as to form a support body which can be provided with one or more of the above-mentioned coatings. The at least partially structured metal sheets are in this case arranged in such a way as to form passages disposed substantially parallel to one another. To ensure this, by way of example, some of the metal sheets are provided with a primary structure, which is distinguished, inter alia, by a regular, recurring structure, in particular in the form of a sine wave structure, a sawtooth structure, a rectangular structure, a triangular structure, an omega structure or the like. These metal sheets which have been provided with the structure are then stacked on top of one another (if appropriate alternating with smooth intermediate layers), wound together and introduced into a housing. This produces a honeycomb body which has passages that are substantially parallel to one another.

Furthermore, it is known to introduce a second structure into sheet-metal foils of this type, this second structure being intended in particular to prevent a laminar flow from forming immediately after the exhaust gas has entered the honeycomb body, in which case there would be no exchange of gas between regions of the partial exhaust-gas stream located in the center of a passage of this type and the, for example, catalytically active passage wall regions. The secondary structure or microstructure provides flow-facing surfaces which cause the partial exhaust-gas streams to be swirled up in the interior of a passage of this type. This leads to intensive mixing of the partial exhaust-gas streams themselves, so that intimate contact between the pollutants contained in the exhaust gas and the passage wall is ensured. It is also possible to use secondary structures of this type to form flow conduits running transversely with respect to the passage, allowing gas exchange between partial exhaust-gas streams in adjacent passages. For this reason, there are known secondary structures which, for example, contain guide surfaces, microstructures, studs, protuberances, wings, tabs, holes or the like. In this respect, there is a much greater variety when producing these metallic honeycomb bodies than when producing those made from ceramic material, since such complex passage walls cannot then be realized or at least can only be realized with particular technical difficulty.

Furthermore, when treating exhaust gas, it is of particular interest for the pollutants contained in the exhaust gas to be converted almost immediately after the engine has started. This should take place with a particularly high efficiency in accordance with the statutory provisions or guidelines. For this reason, ever thinner metal foils or sheets have been used in the past. Very thin metal sheets produce a very low area-specific heat capacity, i.e. relatively little heat is withdrawn from the exhaust gas flowing past, or the sheets themselves are heated up relatively quickly. This is important since the catalytically active coatings which are currently used in the exhaust system only start to convert the pollutants above a certain light-off temperature, which is approximately 230° C. to 270° C. With a view to converting these pollutants with an efficiency of at least 98% after just a few seconds, metal sheets with a thickness of, for example, less than 50 μm (0.05 mm), in particular even less than 30 μm (0.03 mm), are used.

However, the above objectives give rise to a number of manufacturing technology and application problems. The production of such fine structures, in particular the secondary structures or microstructures, requires particularly accurate tools, which are usually very expensive and accordingly need to achieve long service lives. In this context, it should be taken into account that both shaping and possibly also cutting production steps have to be implemented. To save on tooling costs, as many machining steps as possible have been integrated in one tool; on account of the form of the secondary structure, increasing wear to the tool is observed. A further problem is that the relatively thin sheet-metal foils have to be supplied at a suitable velocity, if possible without being exposed to undesirable cold-working. The cold-hardening may have an adverse effect on the forming properties of the metal sheets.

Moreover, on account of the use of relatively thin metal sheets, there is a risk that the sheet-metal foils will tend to become creased, to roll up and/or tear during production. These undesirable deformations may occur and/or be exacerbated as early as during production and also during transport or use in an exhaust system of an automobile. By way of example, creases under certain circumstances cause passages to become blocked and/or cracks to form, and these cracks propagate on account of the high thermal and dynamic stresses in the exhaust system of an automobile, thereby endangering the structural integrity of the honeycomb body. It should also be borne in mind that primary and/or secondary structures which have been deformed or creased in this way constitute undesirable opposition to the exhaust gas, so that there is a risk of an increased back-pressure upstream of the honeycomb body, which can lead to a reduction in the engine power.

SUMMARY OF THE INVENTION

It is accordingly an object of the invention to provide a method of producing a structured metal sheet for exhaust-gas treatment devices and an apparatus for producing the structured metal sheet that overcome the above-mentioned disadvantages of the prior art methods and devices of this general type, which provide structured metal sheets which ultimately can withstand the high thermal and dynamic stresses in the exhaust system of an automobile for a prolonged period of time. In particular, it is intended to overcome the technical problems mentioned in the introduction by producing a very uniform configuration of the primary structure and/or secondary structure, so that production errors can be minimized. At the same time, it is intended to create the possibility of reducing the influence of inhomogeneities in the sheet-metal strip used as a semi-finished product during series production of metal sheets of this type. Moreover, the intention is to specify a particularly space-saving apparatus.

With the foregoing and other objects in view there is provided, in accordance with the invention, a process for producing a structure in a smooth sheet-metal strip. The process included the steps of: a) feeding a first section of a smooth sheet-metal strip to a first tool and feeding a second section of the sheet-metal strip to a second tool in a direction of advance; b) stopping the sheet-metal strip; c) carrying out sheet-metal machining of the first section of the sheet-metal strip using the first tool; and d) carrying out sheet-metal machining of the second section of the sheet-metal strip using the second tool, with the feeding step being carried out simultaneously.

The metal sheets, which are ultimately used in exhaust-gas treatment systems of automobiles, are usually produced from a sheet-metal strip, with the metal sheets ultimately being cut to the desired length from the sheet-metal strip. The sheet-metal strip is formed of a thermally stable, corrosion-resistant material. The material is based on iron and includes at least one of the constituents aluminum, chromium and nickel. Whereas the sheet-metal strip has a length of many meters, the width of the sheet-metal strip substantially already corresponds to the desired width required for the exhaust system. The width is usually in the range of less than 15 cm. The sheet-metal strip has usually been rolled up to form a coil and is supplied via conveying devices.

On account of the fact that in this case two machining steps take place in succession, in each case different sections of the sheet-metal strip are being machined. The first section of the smooth sheet-metal strip is machined first by the first tool and is finally also fed to the second tool. This describes a working step in which, on account of the spatial separation between the first tool and the second tool, the first section (which has been machined by the first tool) is not fed direct to the second tool, but rather the second tool machines a different (second) section of the sheet-metal strip. The second section may in this case already have been machined by the first tool, although it is also possible for the second section still to comprise a smooth region of the sheet-metal strip. The sections preferably extend over the entire width of the sheet-metal strip and are of a length which substantially depends on the structure that is to be produced. It is preferable for the length of the first section and of the second section to be identical. In this case, the section on the smooth sheet-metal strip substantially corresponds to the working region of at least one tool. The term tool is a general term used to indicate a range of devices, equipment, etc. for sheet-metal forming.

On account of the fact that the sheet-metal strip is formed as a continuous single piece, in accordance with the feeding step, the first section is conveyed or fed to the first tool and at the same time a second section is conveyed or fed to the second tool in the desired direction of advance. After the feeding step, therefore, a section of the sheet-metal strip which has not yet been machined by the first or second tool is in each case located in the vicinity of the respective tool. It is preferable for the first section or second section to directly adjoin the section of the sheet-metal strip which has just been machined, as seen in the direction of advance.

When the sheet-metal strip has been fed to the desired position, the sheet-metal strip needs to be stopped. This ensures that there is no relative movement of the sheet-metal strip with respect to the tools while the subsequent steps are being carried out.

Next, sheet-metal machining of the first section of the sheet-metal strip using the first tool is carried out. The "sheet-metal machining" includes in particular sheet-metal forming and cutting production processes. Sheet-metal forming processes are characterized in particular by the fact that the sheet-metal strip is deformed to produce hollow parts or structures over the area, with a substantially uniform material thickness which was also present before the machining step still being present after the machining step. This applies, for example, to the manufacturing processes drawing, pressing, bending, etc. Other forming production processes may include hydroforming, superplastic forming, magnetic forming, etc. The term sheet-metal machining in this context also encompasses sheet-metal cutting processes, for example, cutting or precision cutting, laser cutting, water/abrasive jet cutting, etc.

After the sheet-metal machining of the first section has substantially finished, the sheet-metal machining of the second section using the second tool is carried out. At the same time as the sheet-metal machining of the second section, the feeding step is carried out again, i.e. a (new) first section is fed to the first tool and a (new) second section is fed to the second tool. Therefore, during this two-stage machining, the first machining step is carried out while the sheet-metal strip is stationary, whereas the second machining step is carried out simultaneously with a relative movement of the sheet-metal strip to the tools. This also results in that step d) and step a) are superimposed in terms of time. The result of this is that particularly exact feeding of the sheet-metal strip, which is accurate for the sheet-metal machining using the second tool, is possible. In this context, the sheet-metal machining using the second tool is in particular such that this operation automatically generates a movement of the sheet-metal strip relative to the second tool.

In addition to the particularly accurate feeding of the first section and the second section to the respective tool, simultaneously combining steps d) and a) opens up the possibility of particularly fast machining, so that very high rates of advance of the sheet-metal strip can be achieved. By way of example, rates of advance of over 10 m/min (meters per minute) in particular even over 12 m/min or as much as 15 m/min, can be realized for series production of structured sheet-metal strips of this type. In particular in the case of structures which are not particularly complex, it is even possible to achieve rates of advance of over 25 m/min or even over 50 m/min.

According to a further configuration of the process, step c) includes introducing at least one hole into the first section, and step d) produces a structure in the second section of the sheet-metal strip, with the second section already having been provided with at least one hole. In other words, this results in that in this case the two sheet-metal forming steps are superimposed. The second section, which is in this case provided with a structure, has therefore been machined beforehand using a sheet-metal cutting process. To clarify, in this context it should be pointed out that the term "hole" here is once again used as a generic term for a cut edge of any form which has been introduced into the sheet-metal strip, in particular including a slot, an opening, an elongate hole, a rectangle, etc. On account of the fact that, for example, a plurality or multiplicity of these holes are already present in the second section, the deformation properties of the sheet-metal strip are locally influenced to a considerable extent. Consequently, step d) has to be adapted accordingly. This can be achieved, for example, by the way in which the structure is introduced or by using a particular configuration of the second tool. On account of the fact that the at least one hole is very small compared to the second section as a whole, very accurate alignment of the hole with respect to the second tool is required, which is in this case made possible in particular by the combination of steps a) and d).

In this context, it is particularly advantageous for the second tool to engage in the at least one hole during step d). This engaging on the part of the second tool is in particular to be understood as meaning that sheet-metal forming takes place in the immediate vicinity of the hole, i.e. the region of the sheet-metal strip which adjoins the hole is deformed. After the forming operation, therefore, the second tool can bear against and/or at least partially penetrate through the hole. This also results in, inter alia, that the second tool and the section which was previously machined by step c) form a positive lock when step d) is being carried out. In particular in a process of this type or with the forms of primary and/or secondary structures of very small dimensions described here in the introduction, therefore, accurate feeding of the sections to the tools is ensured even in series production.

According to a further configuration of the process, in step d) a structure in the second section of the sheet-metal strip which has a primary structure and a secondary structure is produced. The primary structure is in this case preferably formed in recurring fashion, advantageously also continuously in succession, over the entire length of the sheet-metal strip. The secondary structure is superimposed on the primary structure or extends over only a spatially limited partial region of the primary structure. As has already been explained in the introduction, the secondary structure may comprise studs, wings, sharp edges or similar structures. The secondary structure is used, inter alia, to influence a fluid flow guided along the surface of the sheet-metal strip, so as to produce swirling and/or calming zones, in which on the one hand a type of turbulent flow or alternatively a reduced flow velocity can be produced with respect to the fluid. With regard to the realization or configuration of secondary structures of this type, reference is made by way of example to international patent disclosure WO 01/80978A1, corresponding to U.S. patent disclosure No. 2003/0072694 A1, the content of which is hereby incorporated by reference in full in the subject of the present disclosure.

According to a preferred configuration of the process, step c) includes stamping a plurality of holes. The stamping process is to be counted among the sheet-metal-cutting production processes, in which a cutting edge or a blade separates part of the material of the sheet-metal strip from other partial regions. During this operation, material may be removed from the sheet-metal strip (so as to form a cutout, an opening, etc.), or alternatively material may simply be pushed aside (as for example in the case of a slot). It is also possible for openings and slots to be formed next to one another in the first section. It is preferable for the plurality of holes to be formed in rows, in particular over the entire width of the sheet-metal strip. For this purpose, it is also possible for a plurality of rows of holes to be introduced simultaneously or at different times.

Furthermore, it is also proposed that step d) includes the corrugation rolling of the sheet-metal strip. In the corrugation-rolling process, the sheet-metal strip is guided through two rotating profiled rolls which mesh with and engage in one another. In the configuration of the process which is specifically proposed here, the corrugation rolls are used not just to produce a structure in the sheet-metal strip but also at the same time to form the conveying member by which the sheet-metal strip is advanced or fed in a defined way. This in particular requires the rolls to effect an advance of the sheet-metal strip, in particular by exerting a force on the sheet-metal strip in the direction of advance.

According to a refinement of the process, steps a) to d) are carried out repeatedly, the repetition rate amounting to at least 5 hertz. For series production, in particular repetition rates of over 10 hertz or even over 20 hertz are preferred. The repetition rate is a measure of the time intervals at which step a) is in each case recommenced. In this context, a repetition rate of 5 hertz results in that process steps a) to d) are repeated five (5) times per second. The process described here for the first time allows very fast and accurate production of structured sheet-metal strips even if they have very complex structures which require a plurality of machining stations to be aligned with respect to one another, while at the same time it is possible to make do without additional monitoring and feed units or feed drives.

According to a further configuration of the process, the sheet-metal strip is tensioned by the second tool and a holding apparatus mounted in front of the first tool. The holding apparatus has the function first of all of relieving the load on the upstream coil. Moreover, the holding apparatus ensures that the sheet-metal strip is tensioned between it and the second tool, as the last forming machining station, so that sagging, compression or the like is avoided. This assists with particularly accurate feeding of sections of the sheet-metal strip to the tools. The holding apparatus used may, for example, be brakes, friction linings or the like.

Moreover, it is also advantageous for the sheet-metal strip to be brought into contact with an operating substance at least before step c). In this context, the term operating substances encompasses in particular oils, lubricants, coolants, etc. The operating substances are intended to assist with the machining or forming of the sheet-metal strip and/or to prevent sticking and jamming of the tools.

A further aspect of the invention proposes an apparatus for producing a structure in a smooth sheet-metal strip. The apparatus includes at least a first tool for sheet-metal machining and a second tool for sheet-metal machining. The invention is characterized in that the first tool and the second tool are disposed in direct succession, and the second tool has a methodology for simultaneously carrying out sheet-metal forming and sheet-metal strip advancing. The apparatus is suitable in particular for carrying out the process according to the invention as described above.

Known apparatuses for producing a structure in a smooth sheet-metal strip, which includes at least two machining steps, had a separate drive and a separate feed device for each machining station. The respective drives were under certain circumstances coupled to one another by a complex electronic control, in order to allow accurate feeding to the respective work station.

It is now proposed that the first tool and the second tool be disposed directly behind one another, i.e. that a separate feed to the tools be dispensed with. The second tool, on account of the machining operation, represents a sheet-metal strip advancing drive both for itself and for the upstream first tool. Accordingly, the second tool draws the sheet-metal strip into the first tool. For this purpose, the second tool has a cyclical drive which in each case allows advance in such a manner that the desired first section is always fed to the first tool. This creates a particularly accurate supply of the sheet-metal strip, since the sheet-metal strip being drawn in by the second tool (independently of further feed devices) maintains a constant relative distance between the first section and second section at all times. The sheet-metal forming preferably takes place simultaneously over the entire width of the sheet-metal strip.

It is particularly advantageous in this context that the first tool and the second tool form a distance in a direction of advance of the sheet-metal strip which is less than 1,000 mm (millimeters). This distance is preferably even less than 500 mm or even less than 200 mm. The omission of separate drives for supplying the sheet-metal strip allows first and second machining stations (or tools) to be positioned spatially very close together. This also results in that the first sheet-metal machining and the second sheet-metal machining are substantially carried out in a region of the sheet-metal strip which has materials properties that deviate only very slightly from one another. This ensures that the sheet-metal machining which is carried out using the first tool is ultimately formed very exactly and positionally accurately with respect to the final position in the second tool. The result is a very space-saving and accurate apparatus.

It is also proposed that the first tool be a stamping tool. This is used in particular to introduce holes, etc. into the sheet-metal strip, which subsequently allow the formation of complex structures using the second tool.

In this context, it is particularly advantageous for the stamping tool to have a lifting drive which produces a working cycle and an idling cycle. This is to be understood as meaning in particular that in practice the stamping tool is driven continuously, but the movement of the stamping tool is only carried out in part of this drive cycle. For this purpose it is possible to use, for example, eccentrics, camshafts or similar equipment, which from time to time move the stamping blade but at other times leave the stamping tool in a stationary position. The drives may be mechanical, hydraulic and/or electromagnetic in form. As a result, the separation of steps c) and d) in accordance with the process described in the introduction is realized in a technically simple way.

According to a further configuration of the apparatus, the second tool includes profiled rollers which mesh with one another. This in particular carries out the production process of corrugation rolling. The profiled rollers which mesh with one another have a surface contour which is such that the contours substantially roll along one another during rotation. In the process, they preferably do not touch one another, but rather maintain a gap between them which substantially corresponds to the thickness of the sheet-metal strip. This achieves particularly gentle forming of the sheet-metal strip.

In an apparatus of this type, it is particularly advantageous for the second tool to have a rotary drive which provides a rotation cycle frequency of at least 5 Hertz [$^1$/second]. On account of the fact that the second tool simultaneously determines the advance of the sheet-metal strip, i.e. acts as a type of conveyor member, the rotation cycle frequency of the rotary drive substantially corresponds to the repetition rate of the machining process. The rotary drive advantageously even allows rotation cycle frequencies of over 10 Hertz, in particular even over 20 Hertz. In this case, by way of example, rotational speeds of over 3000 $^1$/min and more can be achieved.

The apparatus can advantageously be configured in such a way that at least the first tool or the second tool has a working zone which corresponds to a multiple of a width of the structure. Preferred in this context is the configuration whereby both the first tool and the second tool have the same working zone, which corresponds to a multiple of the width of the structure. Very particularly preferred in this context is the configuration of a working zone which corresponds substantially to precisely the width of one structure. This means that, for example if profiled rollers which mesh with one another are provided as the second tool, in each case the working zone of one tooth of the profiled roller, which ultimately determines the width of the structure, is created.

Finally, the invention also proposes the use of a structured metal sheet which has been produced using a process and/or an apparatus as described above, with the structured metal sheet being used to produce an exhaust-gas treatment apparatus for mobile internal combustion engines. It should fundamentally be noted that in this context, the term metal sheet is to be understood as meaning a region of the sheet-metal strip which has been cut to a defined length. Suitable exhaust-gas treatment apparatuses include in particular catalyst support bodies, adsorbers, particulate filters, flow-influencing devices, etc. The term internal combustion engines is to be understood in particular as meaning diesel or spark-ignition engines of automobiles.

Other features which are considered as characteristic for the invention are set forth in the appended claims.

Although the invention is illustrated and described herein as embodied in a method of producing a structured metal sheet for exhaust-gas treatment devices and an apparatus for producing the structured metal sheet, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 3 is a diagrammatic, perspective detail view of a sheet-metal strip with a structure;

FIGS. 4.1-4.3 are diagrammatic, perspective detail views of a configuration of the figure excerpt indicated in FIG. 3;

DESCRIPTION OF THE PREFERRED EMBODIMENTS

Figure 1:
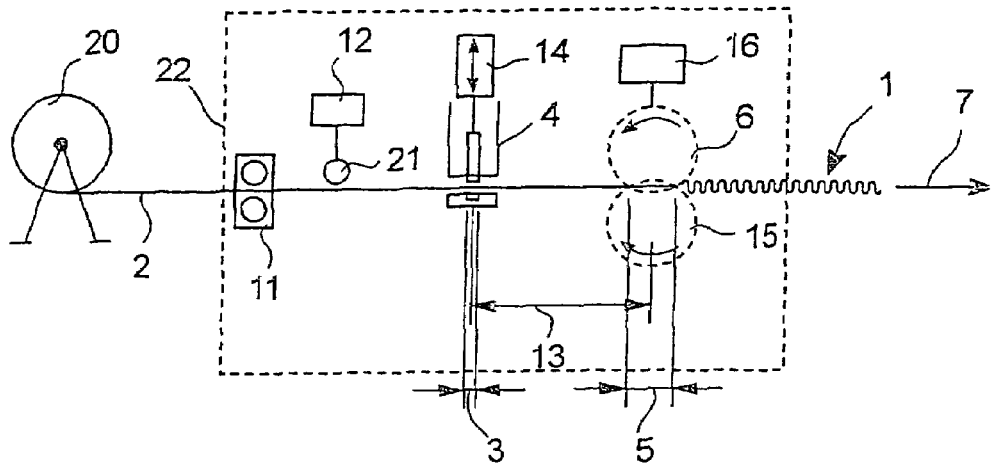
FIG. 1 is a diagrammatic, illustration of a structure of an apparatus for producing a structured metal sheet according to the invention.

Referring now to the figures of the drawing in detail and first, particularly, to FIG. 1 thereof, there is shown a diagrammatic, simplified view of an apparatus for producing a structure 1 in a smooth sheet-metal strip 2. The smooth sheet-metal strip 2 is fed to the apparatus from a stock 20, which is illustrated here in the form of a coil. The apparatus, which is in this case disposed in a common housing 22, contains a first tool 4 for sheet-metal machining and a second tool 6 for sheet-metal machining. The first tool 4 and the second tool 6 are disposed in direct succession. The second tool 6 simultaneously has a device for carrying out a sheet-metal advance in the direction of advance 7. Therefore, simultaneously (with the forming of a second section 5 of the sheet-metal strip 2 using the second tool 6) a first section 3 is fed to the first tool 4 and a new second section 5 is fed to the second tool 6. The second tool 6, which is in this case formed with meshing profiled rollers 15, has a rotary drive 16, which therefore realizes the only advancing of the sheet-metal strip 2 within the apparatus. The first tool 4 is a stamping apparatus and has a lifting drive 14. The first tool 4 and the second tool 6 are at a very short distance 13 from one another.

The sheet-metal strip is tensioned by the second tool 6 and a holding apparatus 11 mounted in front of the first tool 4 and is in this case configured as a brake or frictional resistance. Moreover, a roller 21, by which an operating substance 12 is applied to the surface of the sheet-metal strip 2, is provided between the holding apparatus 11 and the first tool 4.

Figure 2:
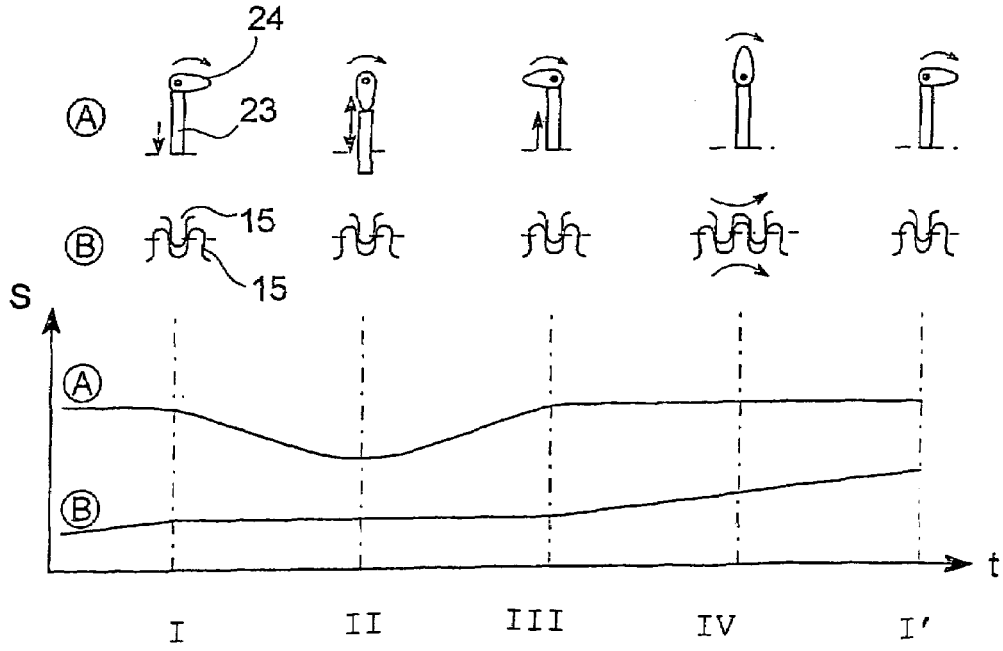
FIG. 2 is an illustration showing an embodiment of the process according to the invention.

FIG. 2 illustrates the movements of the tools 4, 6 during a working cycle. The movement of the first tool 4, containing a (stamping) blade 23 and a camshaft 24, is illustrated in the order given above. The movement of the second tool 6 is illustrated in greatly simplified form, characterizing the movement of the profiled rollers 15 which mesh with one another. The diagram below these sketches illustrates the distance (s) covered by the respective tool over the course of time (t). The two graphs illustrated are denoted by "A" for the movement of the first tool 4 and "B" for the movements of the second tool 6.

Step c) of the process according to the invention, in which sheet-metal machining of the first section of the sheet-metal strip using the first tool 4 is carried out, begins at instant (I). The camshaft 24 moves the blade 23 shown in the figure downward, so that the blade 23 penetrates into the sheet-metal strip. At instant (II), the blade 23 has reached its lowest point, i.e. has penetrated all the way through the sheet-metal strip 2. This is followed by an upward movement of the blade 23 until it has returned to its original position, as at instant (I), at instant (III). The position of the profiled rollers 15 with respect to one another has not changed throughout the entire stamping operation from instant (I) to (III). Only now, at instant (III), do the profiled rollers 15 move toward one another, so as to form a new structure and move the sheet-metal strip in the direction of advance. Although the camshaft is still rotating at this instant, the blade 23 is not performing any working cut. When the camshaft 24 is back in the position at which the blade 23 is just starting the lifting movement (see instant (IV)), the profiled rollers 15 have stopped again, which can be equated to step b) of the process according to the invention. This process of producing a structure in a sheet-metal strip can then start afresh. A repetition rate of at least 5 Hertz is realized, which results in that in this case therefore one fifth of a second has elapsed between (I) and (I').

FIG. 3 shows a diagrammatic and perspective view of part of a sheet-metal strip 2 with a primary structure 9 and a secondary structure 10. In the partial excerpt illustrated, the sheet-metal strip 2 includes a secondary structure 10, which is partially delimited by two holes 8, in this case configured as slots, with these slots extending only within an inner region of the sheet-metal strip 2. The secondary structure 10 projects out of a primary structure 9 of the sheet-metal strip 1. The primary structure 9 is configured with corrugation peaks 25 and corrugation valleys 26. An edge regions 27 of the slots are illustrated on a larger scale, as indicated, in FIGS. 4.1, 4.2 and 4.3 below. The sheet-metal strip 2 is in this case illustrated in a section which substantially corresponds to a working zone 17 of the first tool and of the second tool.

FIGS. 4.1, 4.2 and 4.3 show detail views of the secondary structure 10 which is delimited by the hole 8. The hole 8 enables the secondary structure 10 to be formed out of the sheet-metal strip 2 in such a way that it leaves the primary structure 9. FIG. 4.1 illustrates the edge region 27 as a simple slot. In FIGS. 4.2 and 4.3, recesses 31 are provided in the edge region 27 of the hole 8. The recesses 31 in FIG. 4.2 form an arc of a circle 30 with a radius of curvature 32 which is preferably in the range from 0.2 mm to 0.4 mm. FIG. 4.3 illustrates the recess 31 as an undercut. Other shapes of the recesses 31, for example reducing the notch effect, can also be used.

Figure 5:
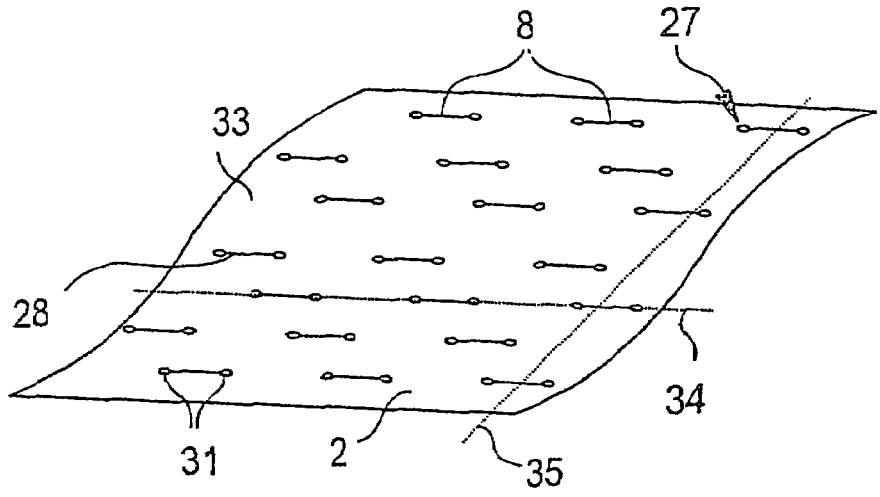
FIG. 5 is an illustration showing an exemplary embodiment of the sheet-metal strip following a first sheet-metal machining operation using a first tool.

FIG. 5 diagrammatically depicts the sheet-metal strip 2 in its configuration which may result after machining by the first tool. The sheet-metal strip 2 has a multiplicity of holes 8, which are disposed in rows 35 or lines 34 with respect to one another. The openings 8 in the edge regions 27 are formed with recesses 31, with the two recesses 31 being connected to one another by slot 28. All the holes 8 are disposed in an inner region 33 of the sheet-metal strip 2. The holes 8 now have to be accurately aligned with the second tool, since they at least partially delimit a secondary structure 10.

Figure 6:
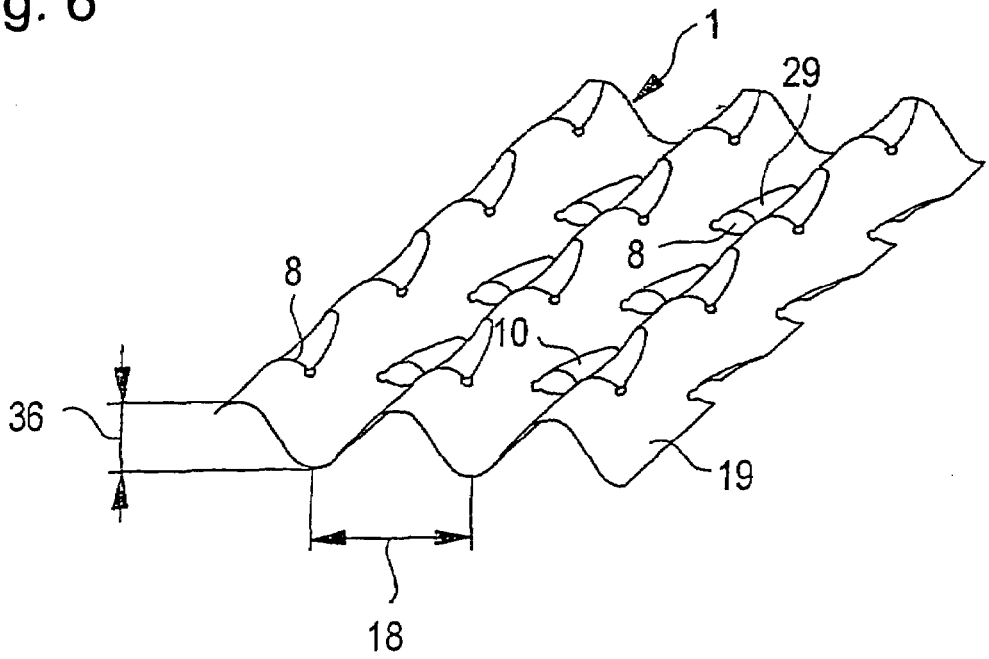
FIG. 6 is an illustration showing an exemplary embodiment of the sheet-metal sheet after it has been produced using the apparatus or process according to the invention.

FIG. 6 shows a finished metal sheet 19 with a structure 1 that has been produced by the process according to the invention or using the apparatus according to the invention. The metal sheet 19 therefore has a structure 1 (or primary structure) with a secondary structure 10 superimposed on it. The secondary structure 10 is in this case formed by guide surfaces 29 which partially delimit the respective hole 8. The guide surfaces 29 are disposed both in the corrugation valleys 26 and in the corrugation peaks 25 and are respectively oppositely oriented. The structure 1 can be described by a height 36 and a width 18; the height 36 is intended to indicate the distance from the corrugation peak 25 to the corrugation valley 26, and the width 18 is intended to indicate the distance between two adjacent corrugation peaks 25 or corrugation valleys 26. The ratio of width 18 to height 36 is preferably in a range from 2.0 to 1.3. It is in this way possible to form passage densities of exhaust-gas treatment devices which are in the range from 100 to 1,000 cpsi (cells per square inch; 6.45 cells per square inch corresponds to one cell per $cm^2$).

The process described here and the apparatus proposed here allow particularly accurate guidance of the sheet-metal strip during the production of very complex structures. At the same time, it is possible to implement a particularly space-saving arrangement of the tools and to realize a high machining rate.

We claim:

1. A process for producing a structure in a smooth sheet-metal strip, which comprises the steps of:

a) feeding a first section of the smooth sheet-metal strip to a first tool and feeding a second section of the sheet-metal strip to a second tool in a direction of advance;

b) stopping the sheet-metal strip;

c) carrying out sheet-metal machining of the first section of the sheet-metal strip using the first tool while introducing at least one hole into the first section;

d) carrying out sheet-metal machining of the second section of the sheet-metal strip using the second tool while producing the structure in the second section of the sheet-metal strip, with the second section already having been provided with the at least one hole, with the second tool engaging in the at least one hole and with step a) being carried out simultaneously; and tensioning the sheet-metal strip with the second tool and a holding apparatus mounted in front of the first tool.

2. The process according to claim 1, which further comprises during step d), producing the structure in the second section of the sheet-metal strip with a primary structure and a secondary structure.

3. The process according to claim 1, which further comprising during step c), stamping a plurality of holes.

4. The process according to claim 1, which further comprising during step d), corrugation rolling of the smooth sheet-metal strip.

5. The process according to claim 1, which further comprises carrying out steps a) to d) repeatedly with a repetition rate of at least 5 hertz.

6. The process according to claim 1, which further comprises bringing the smooth sheet-metal strip into contact with an operating substance at least before performing step c).

7. A method for producing an apparatus, which comprises the steps of:

producing a structure in a smooth sheet-metal strip resulting in a structured sheet-metal strip, by the steps of:

a) feeding a first section of the smooth sheet-metal strip to a first tool and feeding a second section of the sheet-metal strip to a second tool in a direction of advance;

b) stopping the sheet-metal strip;

c) carrying out sheet-metal machining of the first section of the sheet-metal strip using the first tool while introducing at least one hole into the first section;

d) carrying out sheet-metal machining of the second section of the sheet-metal strip using the second tool while producing the structure in the second section of the sheet-metal strip, with the second section already having been provided with the at least one hole, with the second tool engaging in the at least one hole and with step a) being carried out simultaneously;

tensioning the sheet-metal strip with the second tool and a holding apparatus mounted in front of the first tool; and producing an exhaust-gas treatment apparatus for mobile internal combustion engines from the structured sheet-metal strip.

* * * * *